US005991590A

United States Patent [19]

Chang et al.

[11] Patent Number: 5,991,590

[45] Date of Patent: Nov. 23, 1999

[54] TRANSFER/TRANSFUSE MEMBER RELEASE AGENT

[75] Inventors: Shu Chang, Webster; Edward L. Schlueter, Jr., Rochester; Laurence J. Lynd, Macedon, all of N.Y.

[73] Assignee: Xerox Corporation, Stamford, Conn.

[21] Appl. No.: 09/216,762

[22] Filed: Dec. 21, 1998

[51] Int. Cl.[6] ..... G03G 15/01

[52] U.S. Cl. ..... 399/302; 399/307; 399/308

[58] Field of Search ..... 399/297, 307, 399/308, 302, 313, 324, 325; 430/126; 428/391, 447

[56] References Cited

U.S. PATENT DOCUMENTS

| | | | |
|---|---|---|---|
| 3,901,700 | 8/1975 | Yoerger et al. | 430/49 |
| 5,434,657 | 7/1995 | Berkes et al. | 399/308 |
| 5,459,008 | 10/1995 | Chambers et al. | 430/126 |
| 5,469,247 | 11/1995 | Cheng et al. | 399/350 |
| 5,510,886 | 4/1996 | Sugimoto et al. | 399/308 |
| 5,715,510 | 2/1998 | Kusaba et al. | 399/308 |
| 5,758,237 | 5/1998 | Abramsohn | 399/249 |
| 5,870,650 | 2/1999 | Takahashi et al. | 399/98 |

FOREIGN PATENT DOCUMENTS

| | | |
|---|---|---|
| 57-020742 | 2/1982 | Japan . |
| 8-015999 | 1/1996 | Japan . |

*Primary Examiner*—Robert Beatty
*Attorney, Agent, or Firm*—Annette Bade

[57] ABSTRACT

A transfer member having a substrate, an outer silicone rubber layer, and a silicone polymer release agent material, wherein the release agent material is a polydimethyl siloxane cationic liquid emulsion.

13 Claims, 5 Drawing Sheets

TRANSFER/TRANSFUSE MEMBER RELEASE AGENT

BACKGROUND OF THE INVENTION

The present invention relates to transfer members useful in electrostatographic reproducing apparatuses, including digital, image on image and contact electrostatic printing apparatuses. The present transfer members can be used as intermediate transfer members, transfuse or transfix members, transport members, and the like. The transfer members are useful, in embodiments, in liquid ink development applications. In a preferred embodiment, the transfer members comprise a low surface energy release agent such as a polydimethylsiloxane release agent.

In a typical electrostatographic reproducing apparatus such as electrophotographic imaging system using a photoreceptor, a light image of an original to be copied is recorded in the form of an electrostatic latent image upon a photosensitive member and the latent image is subsequently rendered visible by the application of a developer mixture. One type of developer used in such printing machines is a liquid developer comprising a liquid carrier having toner particles dispersed therein. Generally, the toner is made up of resin and a suitable colorant such as a dye or pigment. Conventional charge director compounds may also be present. The liquid developer material is brought into contact with the electrostatic latent image and the colored toner particles are deposited thereon in image configuration.

The developed toner image recorded on the imaging member is transferred to an image receiving substrate such as paper via an intermediate transfer member. The toner particles may be transferred by heat and/or pressure to an intermediate transfer member, or more commonly, the toner image particles may be electrostatically transferred to the intermediate transfer member by means of an electrical potential between the imaging member and the intermediate transfer member. After the toner has been transferred to the intermediate transfer member, it is then transferred to the image receiving substrate, for example by contacting the substrate with the toner image on the intermediate transfer member under heat and/or pressure.

Intermediate transfer members enable high throughput at modest process speeds. In four-color photocopier systems, the intermediate transfer member also improves registration of the final color toner image. In such systems, the four component colors of cyan, yellow, magenta and black may be synchronously developed onto one or more imaging members and transferred in registration onto an intermediate member at a transfer station.

In electrostatographic printing machines in which the toner image is transferred from the intermediate transfer member to the image receiving substrate, it is important that the transfer of the toner particles from the intermediate transfer member to the image receiving substrate be substantially 100 percent. Less than complete transfer to the image receiving substrate results in image degradation and low resolution. Completely efficient transfer is particularly important when the imaging process involves generating full color images since undesirable color deterioration in the final colors can occur when the color images are not completely transferred from the intermediate transfer member.

Thus, it is important that the intermediate transfer member surface has excellent release characteristics with respect to the toner particles. Conventional materials known in the art for use as intermediate transfer members often possess the strength, conformability and electrical conductivity necessary for use as intermediate transfer members, but can suffer from poor toner release characteristics, especially with respect to higher gloss image receiving substrates.

Although use of a release agent increases toner transfer, the transfer member outer layer tends to swell upon addition of the release agent. For example, it has been shown that silicone rubber performs well as a transfer layer, but swells significantly in the presence of hydrocarbon fluid release agent. Also, release properties have been shown to decay from repeated interaction with certain release agents such as hydrocarbon release agents.

U.S. Pat. No. 5,459,008 discloses an intermediate transfer member in combination with a thin film coating of a release agent material comprising a polyolefin, a silicone polymer, or grafts of these polymers, and mixtures thereof.

A need remains for an intermediate transfer member that exhibits substantially 100 percent toner transfer, without system failure, to image receiving substrates having glosses ranging from low to very high. Further, a need remains for a combination of transfer member surface layer and release agent that does not result in significant swelling of the outer layer of the transfer member. In addition, it is desired to present a combination of transfer member layer and release agent in which the release properties of the transfer member do not significantly decay over repeated interaction with the release agent.

SUMMARY OF THE INVENTION

Embodiments of the present invention include: a transfer member comprising a substrate, an outer layer comprising a silicone rubber, and a release agent material coating on the outer layer, wherein the release agent material comprises a low surface energy material.

Embodiments also include: an image forming apparatus for forming images on a recording medium comprising: a charge-retentive surface to receive an electrostatic latent image thereon; a development component to apply a developer material to the charge-retentive surface to develop the electrostatic latent image to form a developed image on the charge retentive surface; a transfer component to transfer the developed image from the charge retentive surface to a copy substrate, the transfer member comprising a substrate, an outer layer comprising a silicone rubber, and a release agent material coating on the outer layer, wherein the release agent material comprises a low surface energy material; and a fixing component to fuse the transferred developed image to the copy substrate.

Embodiments further include: an image forming apparatus for forming images on a recording medium comprising: a charge-retentive surface to receive an electrostatic latent image thereon; a development component to apply a developer material to the charge-retentive surface to develop the electrostatic latent image to form a developed image on the charge retentive surface; and a transfuse component to transfer the developed image from the charge retentive surface to a copy substrate and to fuse the developed image to the copy substrate, the transfuse component comprising a substrate having a heating element associated therewith, an outer layer comprising a silicone rubber, and a release agent material coating on the outer layer, wherein the release agent material comprises a low surface energy material.

BRIEF DESCRIPTION OF THE DRAWINGS

For a better understanding of the present invention, reference may be had to the accompanying figures.

DETAILED DESCRIPTION OF THE PRESENT INVENTION

Figure 1:
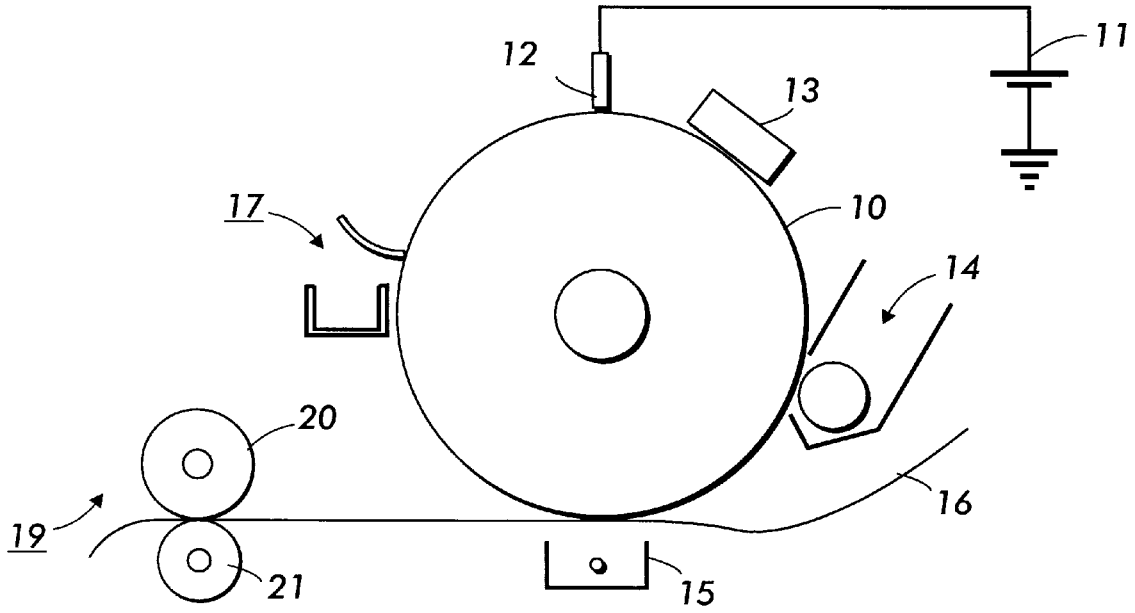
FIG. 1 is a schematic illustration of an image apparatus in accordance with the present invention.

The present invention relates to transfer and transfix or transfuse members having a release agent in combination therewith, in order to enhance transfer of image, and decrease image transfer decays. The present combination of outer transfer material and release agent also enhances the life of the transfer member, by providing a strong outer transfer layer which is less susceptible to swell.

Transfer members are preferably comprised of a material that has good dimensional stability, is resistant to attack by materials of the toner or developer, is conformable to an image receiving substrate such as paper and is preferably electrically semiconductive. Conventional materials known in the art as useful for intermediate transfer members include silicone rubbers, fluorocarbon elastomers such as are available under the trademark VITON® from E. I. du Pont de Nemours & Co., polyvinyl fluoride such as available under the tradename TEDLAR® also available from E. I. du Pont de Nemours & Co, various fluoropolymers such as polytetrafluoroethylene (PTFE), perfluoroalkoxy (PFA-TEFLON®), fluorinated ethylenepropylene copolymer (FEP), other TEFLON®-like materials, and the like and mixtures thereof.

The intermediate transfer member may be in the form of a single layer, or the intermediate transfer member material may be coated upon a thermally conductive and electrically semiconductive substrate, although under some conditions electrically conductive substrates may be used. Examples of suitable substrate materials include but are not limited to polyamides, polyimides, stainless steel, numerous metallic alloys, fabric materials such as those disclosed in U.S. patent application Ser. No. 09/050135, filed Mar. 30, 1998, entitled "Fabric Fuser Film" and the like. Fabrics are materials made from fibers or threads and woven, knitted or pressed into a cloth or felt type structures. Woven, as used herein, refers to closely oriented by warp and filler strands at right angles to each other. Nonwoven, as used herein, refers to randomly integrated fibers or filaments. The fabric material useful as the substrate herein must be suitable for allowing a high operating temperature (i.e., greater than about 180° C., preferably greater than 200° C.), capable of exhibiting high mechanical strength, providing heat insulating properties (this, in turn, improves the thermal efficiency of the proposed fusing system), and possessing electrical insulating properties. In addition, it is preferred that the fabric substrate have a flexural strength of from about 2,000,000 to about 3,000,000 psi, and a flexural modulus of from about 25,000 to about 55,000 psi. Examples of suitable fabrics include woven or nonwoven cotton fabric, graphite fabric, fiberglass, woven or nonwoven polyimide for example KELVAR® available from DuPont), woven or nonwoven polyamide, such as nylon or polyphenylene isophthalamide (for example, NOMEX® of E. L. DuPont of Wilmington, Del.), polyester, polycarbonate, polyacryl, polystyrene, polyethylene, polypropylene, and the like.

In an electrostatographic printing machine, each image being transferred is formed on an imaging member. The imaging member can take conventional forms such as a photoreceptor belt or drum, an ionographic belt or drum, and the like. The image may then be developed by contacting the latent image with a toner or developer at a developing station. The development system can be either wet or dry. The developed image is then transferred to an intermediate transfer member. The image can be either a single image or a multi-image. In a multi-image system, each of the images may be formed on the imaging member and developed sequentially and then transferred to the intermediate transfer member, or in an alternative method, each image may be formed on the imaging member, developed, and transferred in registration to the intermediate transfer member.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to fusing station 19, depicted in FIG. 1 as fuser roll 20 and pressure roll 21 (although any other fusing components such as fuser belt in contact with a pressure roll, fuser roll in contact with pressure belt, and the like, are suitable for use with the present apparatus), wherein the developed image is fused to copy sheet 16 by passing copy sheet 16 between the fusing and pressure members, thereby forming a permanent image. Alternatively, transfer and fusing can be effected by a transfix application.

Photoreceptor 10, subsequent to transfer, advances to cleaning station 17, wherein any toner left on photoreceptor 10 is cleaned therefrom by use of a blade (as shown in FIG. 1), brush, or other cleaning apparatus.

The transfer members employed for the present invention can be of any suitable configuration. Examples of suitable configurations include a sheet, a film, a web, a foil, a strip, a coil, a cylinder, a drum, an endless mobius strip, a circular disc, a belt including an endless belt, an endless seamed flexible belt, an endless seamless flexible belt, an endless belt having a puzzle cut seam, and the like.

The transfer components of the instant invention may be employed in either an image on image transfer or a tandem transfer of a toned image(s) from the photoreceptor to the intermediate transfer component, or in a transfix system for simultaneous transfer and fusing the transferred and developed latent image to the copy substrate. In an image on image transfer, the color toner images are first deposited on the photoreceptor and all the color toner images are then transferred simultaneously to the intermediate transfer component. In a tandem transfer, the toner image is transferred one color at a time from the photoreceptor to the same area of the intermediate transfer component.

Transfer of the developed image from the imaging member to the intermediate transfer element and transfer of the image from the intermediate transfer element to the substrate can be by any suitable technique conventionally used in electrophotography, such as corona transfer, pressure transfer, bias transfer, and combinations of those transfer means, and the like. In the situation of transfer from the intermediate transfer medium to the substrate, transfer methods such as adhesive transfer, wherein the receiving substrate has adhesive characteristics with respect to the developer material, can also be employed. Typical corona transfer entails contacting the deposited toner particles with the substrate and applying an electrostatic charge on the surface of the substrate opposite to the toner particles. A single wire corotron having applied thereto a potential of between about 5,000 and about 8,000 volts provides satisfactory transfer. In a specific process, a corona generating device sprays the back side of the image receiving member with ions to charge it to the proper potential so that it is tacked to the member from which the image is to be transferred and the toner powder image is attracted from the image bearing member to the image receiving member. After transfer, a corona generator charges the receiving member to an opposite polarity to detach the receiving member from the member that originally bore the developed image, whereupon the image receiving member is separated from the member that originally bore the image.

For color imaging, typically, four image forming devices are used. The image forming devices may each comprise an image receiving member in the form of a photoreceptor of other image receiving member. The intermediate transfer member of an embodiment of the present invention is supported for movement in an endless path such that incremental portions thereof move past the image forming components for transfer of an image from each of the image receiving members. Each image forming component is positioned adjacent the intermediate transfer member for enabling sequential transfer of different color toner images to the intermediate transfer member in superimposed registration with one another.

The transfer member moves such that each incremental portion thereof first moves past an image forming component and comes into contact with a developed color image on an image receiving member. A transfer device, which can comprise a corona discharge device, serves to effect transfer of the color component of the image at the area of contact between the receiving member and the intermediate transfer member. In a like fashion, image components of colors such as red, blue, brown, green, orange, magenta, cyan, yellow and black, corresponding to the original document also can be formed on the intermediate transfer member one color on top of the other to produce a full color image.

A transfer sheet or copy sheet is moved into contact with the toner image on the intermediate transfer member. A bias transfer member may be used to provide good contact between the sheet and the toner image at the transfer station. A corona transfer device also can be provided for assisting the bias transfer member in effecting image transfer. These imaging steps can occur simultaneously at different incremental portions of the intermediate transfer member. Further details of the transfer method employed herein are set forth in U.S. Pat. No. 5,298,956 to Mammino, the disclosure of which is hereby incorporated by reference in its entirety.

The transfer member herein can be employed in various devices including, but not limited to, devices described in U.S. Pat. Nos. 3,893,761; 4,531,825; 4,684,238; 4,690,539; 5,119,140; and 5,099,286; the disclosure of all of which are hereby incorporated by reference in their entirety.

Figure 2:
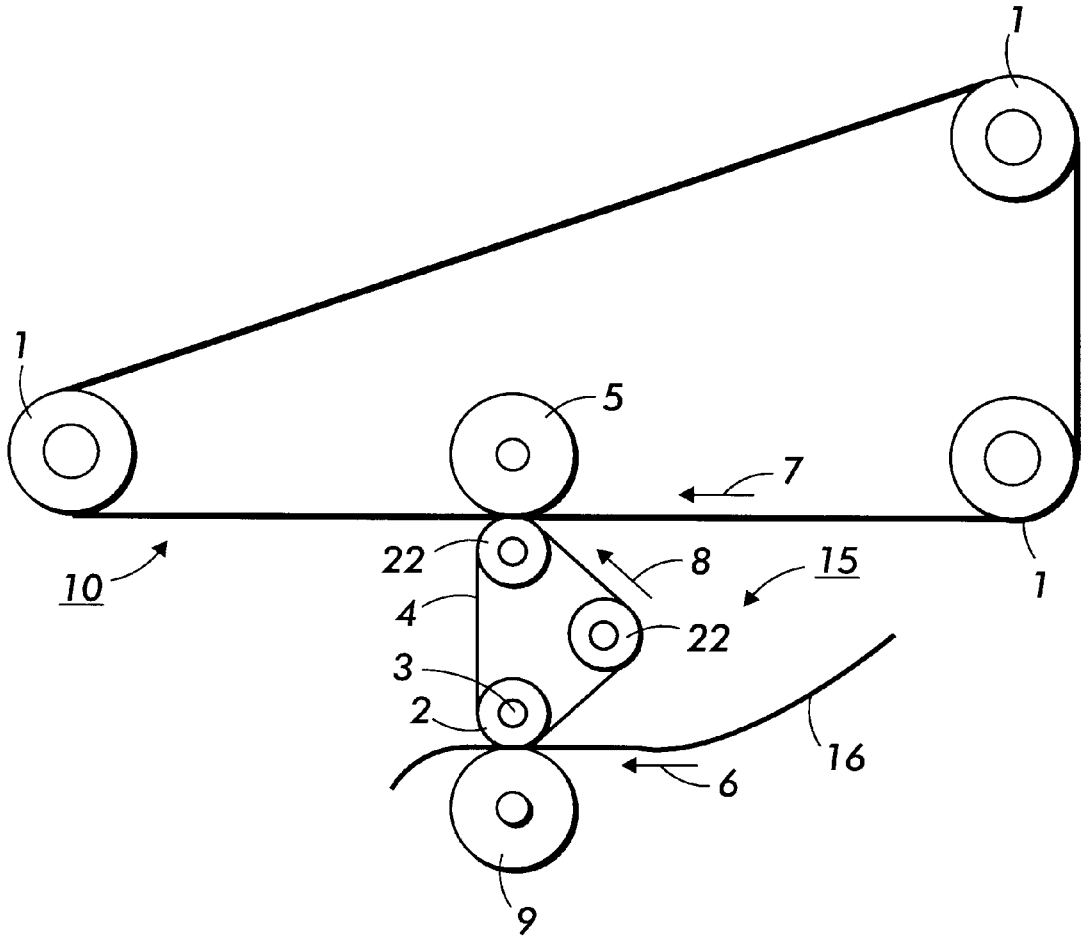
FIG. 2 is an illustration of an embodiment of the present invention, and represents a transfuse member.

Transfer and fusing may occur simultaneously in a transfix configuration. As shown in FIG. 2, a transfer apparatus 15 is depicted as transfix belt 4 being held in position by driver rollers 22 and heated roller 2. Heated roller 2 comprises a heater element 3. Transfix belt 4 is driven by driving rollers 22 in the direction of arrow 8. The developed image from photoreceptor 10 (which is driven in direction 7 by rollers 1) is transferred to transfix belt 4 when contact with photoreceptor 10 and belt 4 occurs. Pressure roller 5 aids in transfer of the developed image from photoreceptor 10 to transfix belt 4. The transferred image is subsequently transferred to copy substrate 16 and simultaneously fixed to copy substrate 16 by passing the copy substrate 16 between belt 4 (containing the developed image) and pressure roller 9. A nip is formed by heated roller 2 with heating element 3 contained therein and pressure roller 9. Copy substrate 16 passes through the nip formed by heated roller 2 and pressure roller 9, and simultaneous transfer and fusing of the developed image to the copy substrate 16 occurs.

Figure 3:
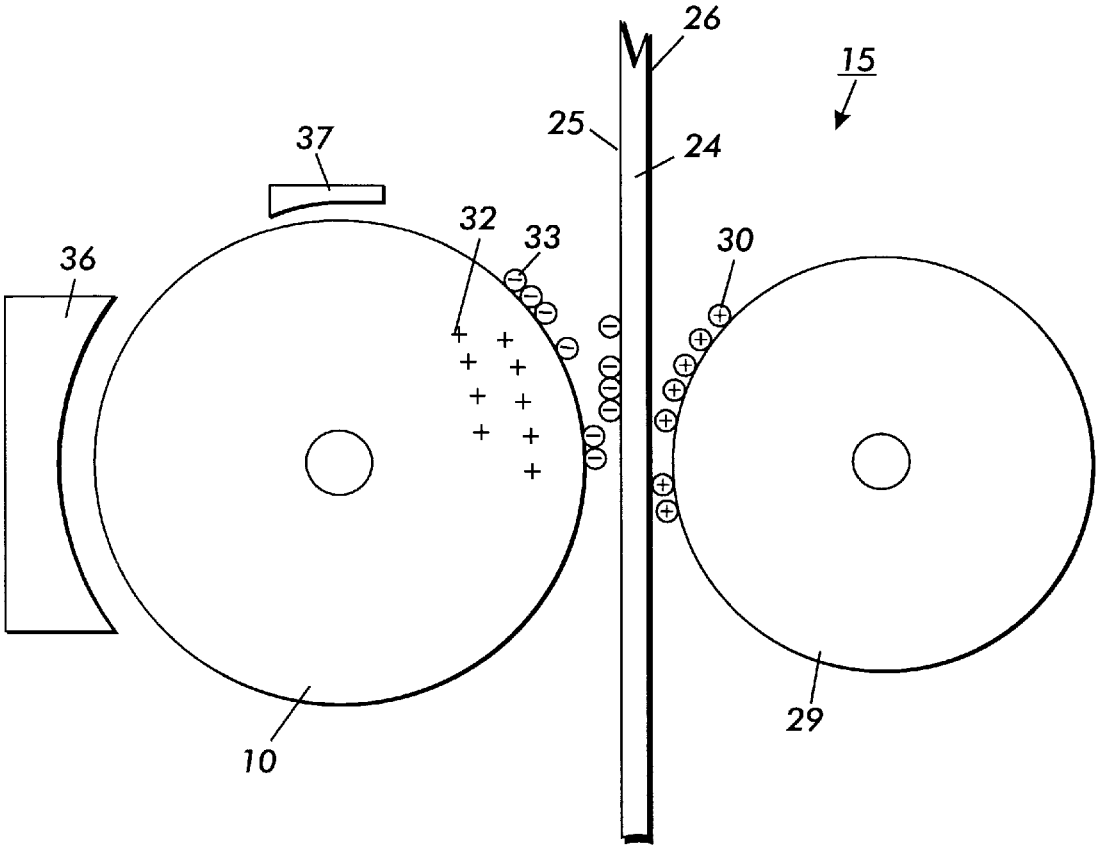
FIG. 3 is a schematic view of an image development system containing a transfer member.

FIG. 3 demonstrates another embodiment of the present invention and depicts a transfer apparatus 15 comprising an intermediate transfer member 24 positioned between an imaging member 10 and a transfer roller 29. The imaging member 10 is exemplified by a photoreceptor drum. However, other appropriate imaging members may include other electrostatographic imaging receptors such as ionographic belts and drums, electrophotographic belts, and the like.

In the multi-imaging system of FIG. 3, each image being transferred is formed on the imaging drum by image forming station 36. Each of these images is then developed at developing station 37 and transferred to intermediate transfer member 24. Each of the images may be formed on the photoreceptor drum 10 and developed sequentially and then transferred to the intermediate transfer member 24. In an alternative method, each image may be formed on the photoreceptor drum 10, developed, and transferred in registration to the intermediate transfer member 24. In a preferred embodiment of the invention, the multi-image system is a color copying system. In this color copying system, each color of an image being copied is formed on the photoreceptor drum. Each color image is developed and transferred to the intermediate transfer member 24. As above, each of the colored images may be formed on the drum 10 and developed sequentially and then transferred to the intermediate transfer member 24. In the alternative method, each color of an image may be formed on the photoreceptor drum 10, developed, and transferred in registration to the intermediate transfer member 24.

After latent image forming station 36 has formed the latent image on the photoreceptor drum 10 and the latent image of the photoreceptor has been developed at developing station 37, the charged toner particles 33 from the developing station 37 are attracted and held by the photoreceptor drum 10 because the photoreceptor drum 10 possesses a charge 32 opposite to that of the toner particles 33. In FIG. 3, the toner particles are shown as negatively charged and the photoreceptor drum 10 is shown as positively charged. These charges can be reversed, depending on the nature of the toner and the machinery being used. In a preferred embodiment, the toner is present in a liquid developer. However, the present invention, in embodiments, is useful for dry development systems also.

A biased transfer roller 29 positioned opposite the photoreceptor drum 10 has a higher voltage than the surface of the photoreceptor drum 10. As shown in FIG. 3, biased transfer roller 29 charges the backside 26 of intermediate transfer member 24 with a positive charge. In an alternative embodiment of the invention, a corona or any other charging mechanism may be used to charge the backside 26 of the intermediate transfer member 24.

The negatively charged toner particles 33 are attracted to the front side 25 of the intermediate transfer member 24 by the positive charge 30 on the backside 26 of the intermediate transfer member 24.

The intermediate transfer member may be in the form of a sheet, web or belt as it appears in FIG. 3, or in the form of a roller or other suitable shape. In a preferred embodiment of the invention, the intermediate transfer member is in the form of a belt. In another embodiment of the invention, not shown in the figures, the intermediate transfer member may be in the form of a sheet.

Figure 4:
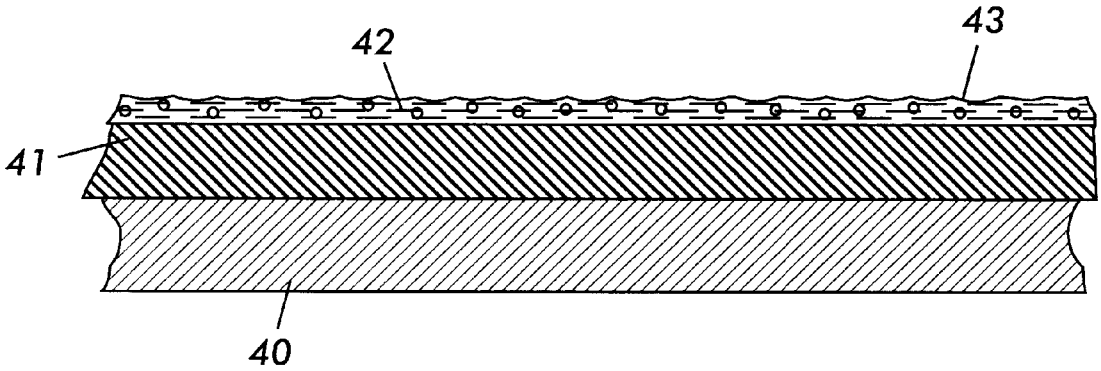
FIG. 4 is an illustration of an embodiment of the invention, demonstrating an outer rubber layer in combination with a release layer.

FIG. 4 demonstrates a two layer configuration of an embodiment of the present invention. Included therein is a substrate 40, outer rubber layer 41, and release agent material layer 42. In a preferred embodiment, the release agent comprises fillers 43.

Preferably, the outer layer is comprised of a suitable high elastic modulus material such as a silicone rubber material. The material should be capable of becoming conductive upon the addition of electrically conductive particles. The silicone rubber used herein has the advantages of improved flex life and image registration, chemical stability to liquid developer or toner additives, thermal stability for transfix applications and for improved overcoating manufacturing, improved solvent resistance as compared to known materials used for film for transfer components. Silicone rubber further provides for lower pull force which allows the material to perform well in transfix and transfuse applications. The low pull force is believed to be a function of low adhesive and low surface energy properties of the silicone material. The low modulus silicone material also assists in conformability of the toner to the final substrate.

Examples of suitable silicone rubber materials room temperature vulcanization (RTV) silicone rubbers; high temperature vulcanization (HTV) silicone rubbers and low temperature vulcanization (LTV) silicone rubbers. These rubbers are known and readily available commercially such as SILASTIC® 735 black RTV and SILASTIC® 732 RTV, both from Dow Corning; and 106 RTV Silicone Rubber and 90 RTV Silicone Rubber, both from General Electric. Other suitable silicone materials include the siloxanes (preferably polydimethylsiloxanes); fluorosilicones such as Silicone Rubber 552, available from Sampson Coatings, Richmond, Va.; dimethylsilicones; liquid silicone rubbers such as vinyl crosslinked heat curable rubbers or silanol room temperature crosslinked materials; and the like.

The silicone rubber is present in the outer layer in an amount of from about 10 to about 98 percent, preferably from about 25 to about 50 percent by weight of total solids. The thickness of the silicone rubber layer is from about 2 microns to about 125 microns, preferably from about 8 to about 75 microns, and particularly preferred about 12 to about 25 microns.

It is preferred that the silicone rubber contain a resistive filler such as carbon black; graphite; boron nitride; metal oxides such as copper oxide, zinc oxide, titanium dioxide, silicone dioxide, and the like, and mixtures thereof. These types of fillers are used to impart electrical or thermal properties that assist in the transfer and release of thicker coatings. Thinner silicone surface coatings are preferred with minimal fillers to achieve the lowest surface energy possible. If a filler is present, it is preferably present in an amount to aid in imparting the electrical or thermal property, but minimally increasing the surface energy of the total formulation. If a filler is present in the outer silicone layer, it is present in an amount of less than about 20 percent, preferably from about 0.5 to about 20 percent.

In a preferred embodiment, a release agent is used in combination with the intermediate transfer member or transfix member. Preferred release agents include low surface energy release agents such as silicones, waxes, fluoropolymers and like materials. Oil or waxed-based release agents tend to cause a silicone rubber outer transfer layer to swell. Therefore, particularly preferred release agents are aqueous silicone polymer release agents such as aqueous polydimethyl siloxane, fluorosilicone, fluoropolymers, and the like. In a particularly preferred embodiment, the release agent is a polydimethyl siloxane release agent that is a liquid emulsion instead of oil-based or wax-based, and comprises cationic electrical control agents or metallic end group polymers to impart cationic electrical conductivity. Examples of commercially available silicone release agents include GE Silicone SM2167 Antistat®, General electric SF1023, DF1040, SF1147, SF1265, SF1706, SF18-350, SF96, SM2013, SM2145, SF1154, SM3030, DF104, SF1921, SF1925, SF69, SM2101, SM2658, SF1173, SF1202 and SF1204.

The release agent material may or may not comprise conductive fillers. Suitable conductive fillers include carbon black; graphite; boron nitride; metal oxides such as copper oxide, zinc oxide, titanium dioxide, silicone dioxide, and the like, and mixtures thereof. If a filler is present in the release agent material, it is preferably present in an amount of from about 0.5 to about 40 percent, preferably from about 0.5 to about 15 percent by weight of total solids.

The release agent is applied to the transfer member as a relatively thin outer coating layer prior to transfer of the developer material. Preferably, the release agent is applied to the transfer member by a wick, roller, or other known application member. The release agent is supplied in an amount of from about 0.1 to about 15 $\mu$l/copy, preferably from about 0.1 to about 2 $\mu$l/copy, and as a thin film covering the silicone rubber outer layer of the transfer member. The thin film of the release agent has a thickness of from about 2 microns to about 125 microns, preferably from about 8 to about 75 microns, and particularly preferred about 12 to about 25 microns.

The volume resistivity of the transfer member is from about $10^4$ to about $10^{14}$, and preferably from about $10^8$ to about $10^{10}$ ohms/sq.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example I

Liquid color toner (Xerox liquid hydrocarbon No. 28143-3—20% solids ink) in an amount of from about 20 to about 40 percent was screen printed onto silicone coated substrate belt material in the form of sheets (AR8001 from Adhesive Research). The image was dried at various temperatures. The silicone coated substrate sheets with the image on them, along with a copy substrate of plain, non-imaged paper, were positioned between a nip formed by a pressure member and a fuser member. Various paper substrates were tested. The pressure member consisted of a rubber roller about 3 inches in diameter with a silicone rubber coated to a thickness of approximately 0.75 inch. The fuser roll was also approximately 3 inches in diameter and had approximately 0.010 inches thick of a VITON® coating material. The pressure member also comprised heated platents to dry and heat the paper before nip entry. The rollers were not heated.

After the transfuse silicone coated sheets and paper substrates were pulled from the nip formed by the pressure and fuser rollers, the transfer of toner to the paper substrates was examined. A 100% transfer occurs when all the toner is transferred from the transfuse member to the paper substrates, and no toner is visibly remains on the transfuse member. Also, regular scotch-brand tape was placed on the transfuse member in an attempt to pull off any remaining toner left on the transfuse member.

After repeated tests, the silicone coated paper sheets were adversely affected by the hydrocarbon fluid and release began to degrade. The degraded sample was then subjected to a thin application of aqueous silicone material [SM2167 (aqueous emulsion of PDMS cationic material from General Electric)]. The release was renewed and continued to for long periods of time.

A 100% silicone oil-based is tacky and swells the processing material such as the other silicone rubber layer. Therefore, it is preferred that relatively small amounts of the aqueous emulsion of PDMS cationic material be applied to maintain release.

Figure 5:
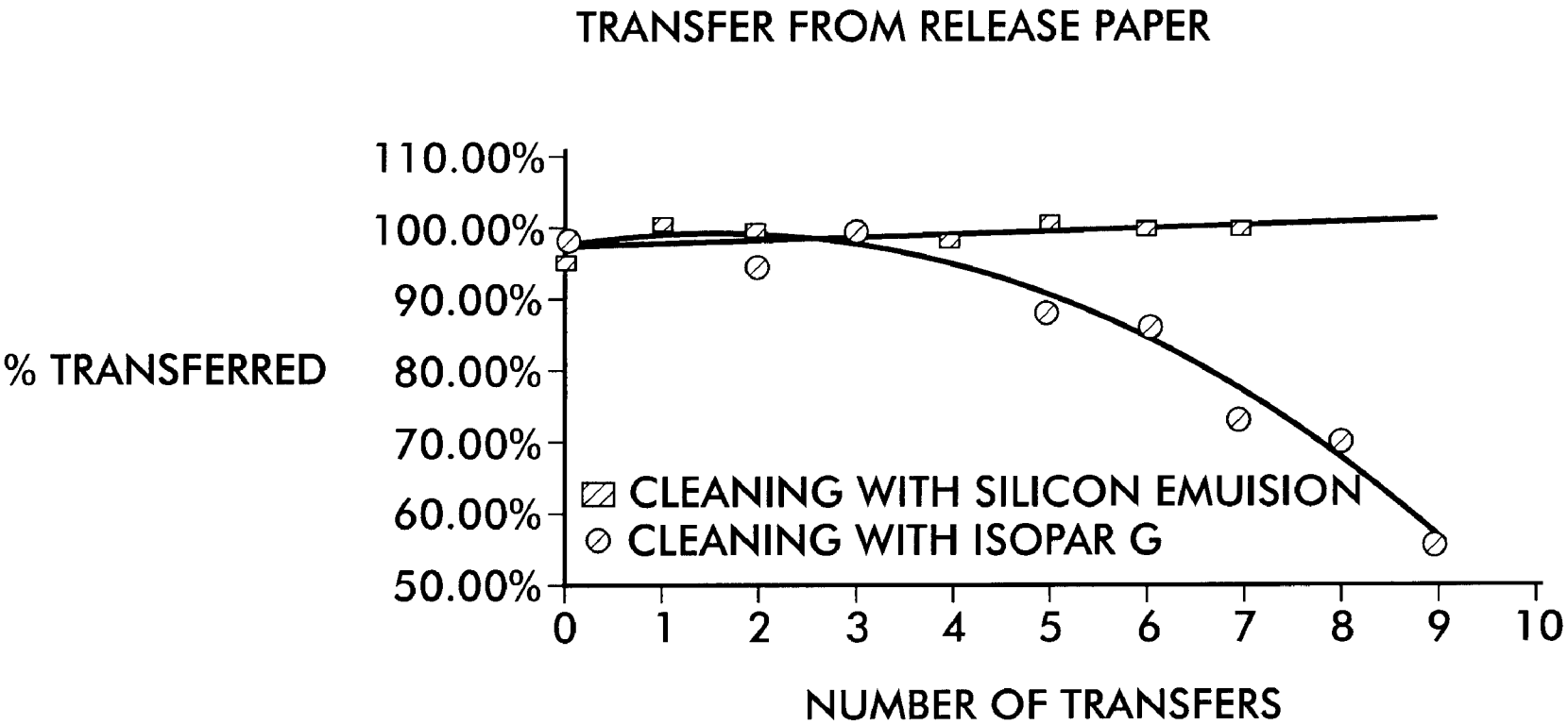
FIG. 5 is a graph of a number of transfers versus percent toner transfer.

FIG. 5 demonstrates the results obtained by the above test procedure. The square points represent the above transfuse member including addition of the polydimethyl siloxane liquid cationic emulsion. Note that release does not decrease as the number of transfers increases. This is in stark contrast to the comparative curve, wherein the circles represent the above transfuse member tested without the presence of the PDMS emulsion, but instead in the presence of a hydrocarbon release agent (Isopar®). Note that release decreases significantly as the number of transfers increases.

Example II

Several transfuse materials were tested for pull force. Standard polyimide substrates were purchased from DuPont. Different outer coatings were coated by a standard, known drawn down method onto the polyimide substrates. The coatings included VITON®, PFA and silicone rubber. The transfuse members were tested for pull forces by the Instron Pull Test method (release tape test) as follows. The transfuse members were subjected to a pull strength test using an Instron 1122 mechanical tester. A load cell of 50 pounds and a cross head speed of 10 inch/minute were used for the testing. The VITON® materials demonstrated pull forces of 34 oz/in, PFA demonstrated pull forces at 4 oz/in, and silicone rubber at 0.2 oz/in. The lower the pull force, the better the transfuse ability. The best transferring and transfuse material was determined be the silicone rubber.

Therefore, superior release properties in transfuse are obtained by a combination of silicone rubber outer layer and aqueous cationic emulsion of PDMS release agent.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A transfer member comprising a substrate, an outer layer comprising a silicone rubber, and a release agent material coating on said outer layer, wherein said release agent material comprises a polydimethyl siloxane cationic liquid emulsion.

2. A transfer member in accordance with claim 1, wherein said release agent material further comprises conductive fillers.

3. A transfer member in accordance with claim 2, wherein said conductive filler is selected from the group consisting of carbon black, graphite, metal oxides, and mixtures thereof.

4. A transfer member in accordance with claim 1, wherein said silicone rubber is selected from the group consisting of room temperature vulcanization silicone rubbers, high temperature vulcanization silicone rubbers, and low temperature vulcanization silicone rubbers.

5. A transfer member in accordance with claim 1, wherein said silicone rubber outer layer has a thickness of from about 2 to about 125 microns.

6. A transfer member in accordance with claim 1, wherein said release agent material coating has a thickness of from about 2 to about 125 microns.

7. A transfer member in accordance with claim 1, wherein said transfer member is in the form of a belt.

8. A transfer member in accordance with claim 1, wherein said substrate comprises a material selected from the group consisting of fabrics and polyimides.

9. An image forming apparatus for forming images on a recording medium comprising:

a charge-retentive surface to receive an electrostatic latent image thereon;

a development component to apply a developer material to said charge-retentive surface to develop said electrostatic latent image to form a developed image on said charge retentive surface;

a transfer component to transfer the developed image from said charge retentive surface to a copy substrate, said transfer member comprising a substrate, an outer layer comprising a silicone rubber, and a release agent material coating on said outer layer, wherein said release agent material comprises a polydimethyl siloxane cationic liquid emulsion; and a fixing component to fuse said transferred developed image to said copy substrate.

10. An apparatus in accordance with claim 9, wherein said developer material is a liquid developer comprising toner particles.

11. An apparatus in accordance with claim 9, wherein said release agent material further comprises conductive fillers.

12. An image forming apparatus for forming images on a recording medium comprising:

a charge-retentive surface to receive an electrostatic latent image thereon;

a development component to apply a developer material to said charge-retentive surface to develop said electrostatic latent image to form a developed image on said charge retentive surface; and a transfuse component to transfer the developed image from said charge retentive surface to a copy substrate and to fuse said developed image to said copy substrate, said transfuse component comprising a substrate having a heating element associated therewith, an outer layer comprising a silicone rubber, and a release agent material coating on said outer layer, wherein said release agent material comprises a polydimethyl siloxane cationic liquid emulsion.

13. An apparatus in accordance with claim 12, wherein said developer material is a liquid developer comprising toner particles.

* * * * *